US010630024B1

(12) United States Patent
Su et al.

(10) Patent No.: US 10,630,024 B1
(45) Date of Patent: Apr. 21, 2020

(54) CONNECTING DEVICE

(71) Applicant: NEXTRONICS ENGINEERING CORP., New Taipei (TW)

(72) Inventors: Hou-An Su, Keelung (TW); Yong Zhang, Guangzhou (CN)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 16/456,824

(22) Filed: Jun. 28, 2019

(30) Foreign Application Priority Data

Feb. 20, 2019 (TW) ..... 108105595 A

(51) Int. Cl.

| | |
|---|---|
| ***H01R 13/629*** | (2006.01) |
| ***H01R 13/502*** | (2006.01) |
| ***H01R 24/58*** | (2011.01) |
| ***H01R 13/518*** | (2006.01) |
| ***H01R 13/627*** | (2006.01) |
| ***H01R 107/00*** | (2006.01) |

(52) U.S. Cl.
CPC ..... *H01R 13/629* (2013.01); *H01R 13/502* (2013.01); *H01R 13/518* (2013.01); *H01R 13/6271* (2013.01); *H01R 24/58* (2013.01); *H01R 2107/00* (2013.01)

(58) Field of Classification Search
CPC .. H01R 13/629; H01R 13/502; H01R 13/518; H01R 13/6271; H01R 13/62; H01R 13/625; H01R 2107/00
See application file for complete search history.

(56) References Cited

U.S. PATENT DOCUMENTS

| | | | | |
|---|---|---|---|---|
| 5,637,010 A * | 6/1997 | Jost | H01R 13/6277 | 439/352 |
| 7,744,383 B2 * | 6/2010 | Da Silva | H01R 9/037 | 439/92 |
| 8,142,218 B2 * | 3/2012 | Rudolph | H01R 13/627 | 439/357 |
| 8,177,575 B2 * | 5/2012 | Katagiyama | H01R 13/625 | 439/345 |
| 8,951,056 B2 * | 2/2015 | Pichot | H01R 13/523 | 439/294 |

(Continued)

FOREIGN PATENT DOCUMENTS

CN 103618168 A 3/2014

*Primary Examiner* — Briggitte R. Hammond
(74) *Attorney, Agent, or Firm* — Li & Cai Intellectual Property (USA) Office

(57) ABSTRACT

A connecting device includes a first connector and a second connector. The first connector includes a first insulating body, a plurality of first terminals and a first outer housing. A front end of the first insulating body has a plurality of first buckle bodies. Two opposite sides of each first buckle body are respectively arranged with two first grooves, and the rear ends of the two first grooves communicate with each other via a second groove. The second connector includes a second insulating body, a plurality of second terminals, an inner housing, a second outer housing, a locking member and an elastic member. The locking member is disposed inside the second outer housing. The elastic member is disposed between the inner housing and the second outer housing. The locking member has a plurality of second buckle bodies which respectively correspond in position to the first buckle bodies.

9 Claims, 8 Drawing Sheets

(56) References Cited

U.S. PATENT DOCUMENTS

| | | | | |
|---|---|---|---|---|
| 9,236,688 | B2 * | 1/2016 | Friedhof | H01R 13/6461 |
| 9,570,853 | B1 * | 2/2017 | Yu | H01R 13/639 |
| 9,680,268 | B1 * | 6/2017 | Finona | H01R 24/38 |
| 9,692,174 | B1 * | 6/2017 | Yu | H01R 13/622 |
| 9,876,301 | B2 * | 1/2018 | Zhou | F21V 23/0407 |
| 10,490,937 | B1 * | 11/2019 | Su | H01R 24/40 |
| 2013/0137287 | A1 * | 5/2013 | Grimm | H01R 13/625 439/345 |
| 2014/0017928 | A1 * | 1/2014 | Shah | H01R 13/6277 439/350 |
| 2014/0235085 | A1 * | 8/2014 | Su | H01R 13/6277 439/346 |
| 2014/0302724 | A1 * | 10/2014 | Ono | H01R 13/4364 439/751 |

* cited by examiner

CONNECTING DEVICE

CROSS-REFERENCE TO RELATED PATENT APPLICATION

This application claims the benefit of priority to Taiwan Patent Application No. 108105595, filed on Feb. 20, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connecting device, and more particularly to an electrically connecting device that can be used to lock and unlock two connectors.

BACKGROUND OF THE DISCLOSURE

A conventional connecting device includes a first connector and a second connector. The first connector and the second connector can be respectively disposed at a board end and a wire end. The first connector can be plugged into the second connector to achieve an electrical connection. To provide a firm connection between the first connector and the second connector, a locking structure is generally configured between the first connector and the second connector.

In the conventional connecting device, the first connector and the second connector are each provided with a triangular buckle point. When the first connector is plugged into the second connector, the two triangular buckle points slide over each other, and the first connector can rotate relative to the second connector to compress a spring disposed in the connecting device. The spring provides an elastic force acting on the first connector and the second connector so that the first connector and the second connector automatically rotate to their original position, and the two triangular buckle points are engaged with each other. However, when the first connector and the second connector need to be separated, the connectors can be rotated in only one direction by a user. If the direction of rotation is incorrect, the unlocking operation cannot be performed, which is inconvenient for the user.

SUMMARY OF THE DISCLOSURE

In response to the above-referenced technical inadequacies, the present disclosure provides a connecting device having a bi-directional unlocking function to facilitate the unlocking operation.

In one aspect, the present disclosure provides a connecting device including a first connector and a second connector. The first connector includes a first insulating body, a plurality of first terminals and a first outer housing. The first terminals are disposed through the first insulating body, the first outer housing is sleeved outside the first insulating body, the first outer housing has a first housing portion, and the front end of the first housing portion has a plurality of first buckle bodies. The first outer housing further has a plurality of first grooves and a plurality of second grooves, any two of the first grooves adjacent to each other are arranged at two opposite sides of one of the first buckle bodies, and the second grooves are respectively arranged at rear sides of the first buckle bodies. In each of the first buckle bodies and the corresponding two first grooves and the corresponding second groove, the rear ends of the two first grooves communicate with the second groove. The second connector includes a second insulating body, a plurality of second terminals, an inner housing, a second outer housing, a locking member and an elastic member. The second terminals are disposed through the second insulating body, the inner housing is sleeved outside the second insulating body, and the second outer housing is sleeved outside the inner housing in a rotatable manner. The locking member has a locking body and a plurality of second buckle bodies, the second buckle bodies are connected to the locking body, the locking body of the locking member is fixed onto the second outer housing, the elastic member is disposed between the inner housing and the second outer housing, and the elastic member is configured to push the second outer housing to its original position. When the first connector is plugged into the second connector, the first terminals are respectively in contact with the second terminals to achieve electrical connection, the first buckle bodies are configured to be respectively buckled to the second buckle bodies to provide a locking function, and the second buckle bodies are respectively located in the second grooves located at the rear sides of the first buckle bodies. When the first connector and the second connector are to be separated, the second outer housing are capable of being rotated along a clockwise direction or a counterclockwise direction, such that the second buckle bodies can respectively slide to the rear ends of the adjacent first grooves through the second grooves, and then the second buckle bodies can respectively slide to the front ends of the adjacent first grooves to provide an unlocking function.

Therefore, when a user wants to separate the first connector and the second connector, the user can rotate the second outer housing along a clockwise direction or a counterclockwise direction, such that the second buckle bodies can respectively slide to the rear ends of the adjacent first grooves through the second grooves, and then the second buckle bodies can respectively slide to the front ends of the adjacent first grooves to separate the first buckle bodies and the second buckle bodies, thereby achieving the unlocking function. The connecting device of the present embodiment has the bi-directional unlocking function to facilitate the unlocking operation.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
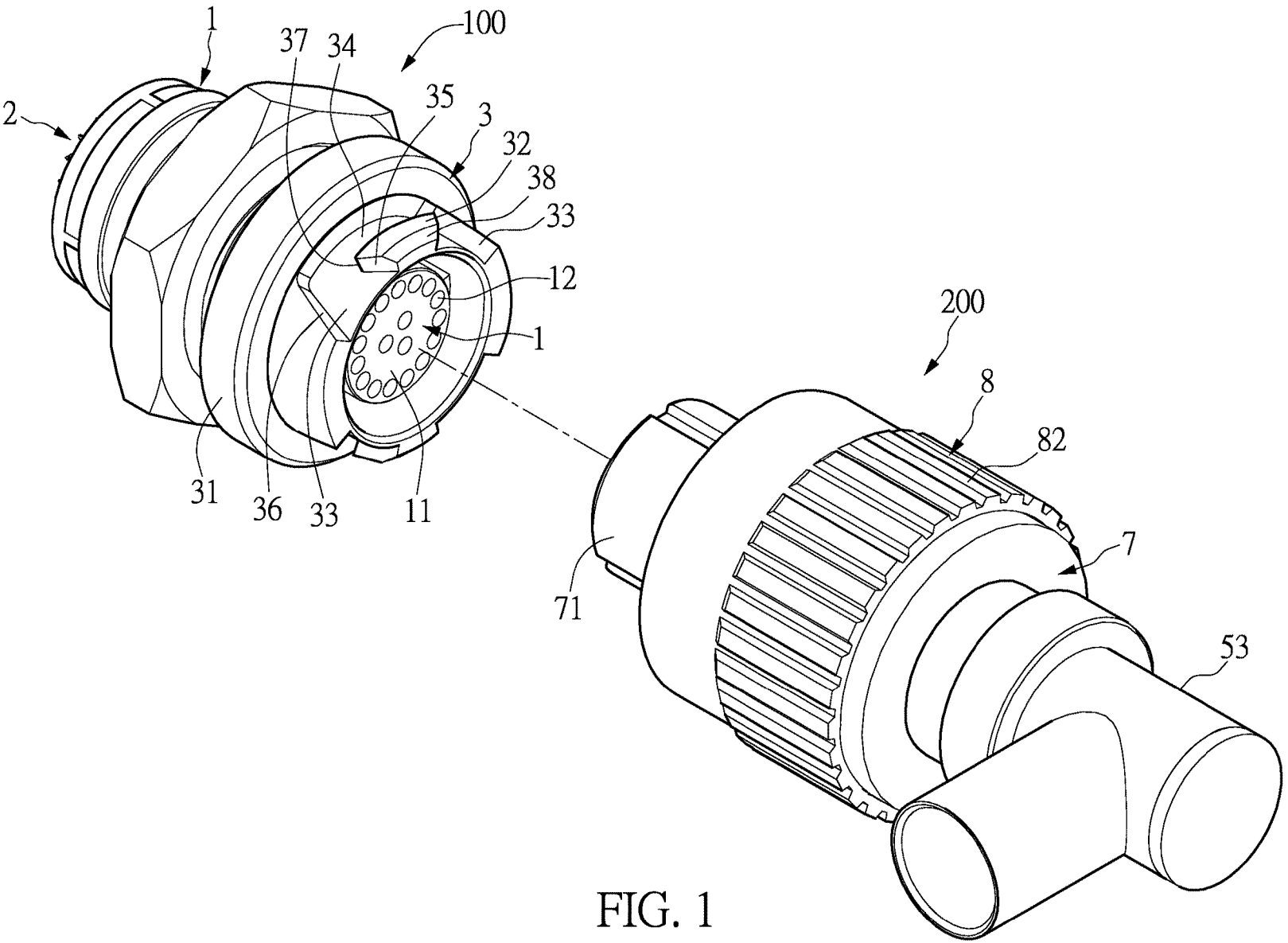
FIG. 1 is a perspective view showing a separated state of a connecting device according to an embodiment of the present disclosure.
Figure 2:
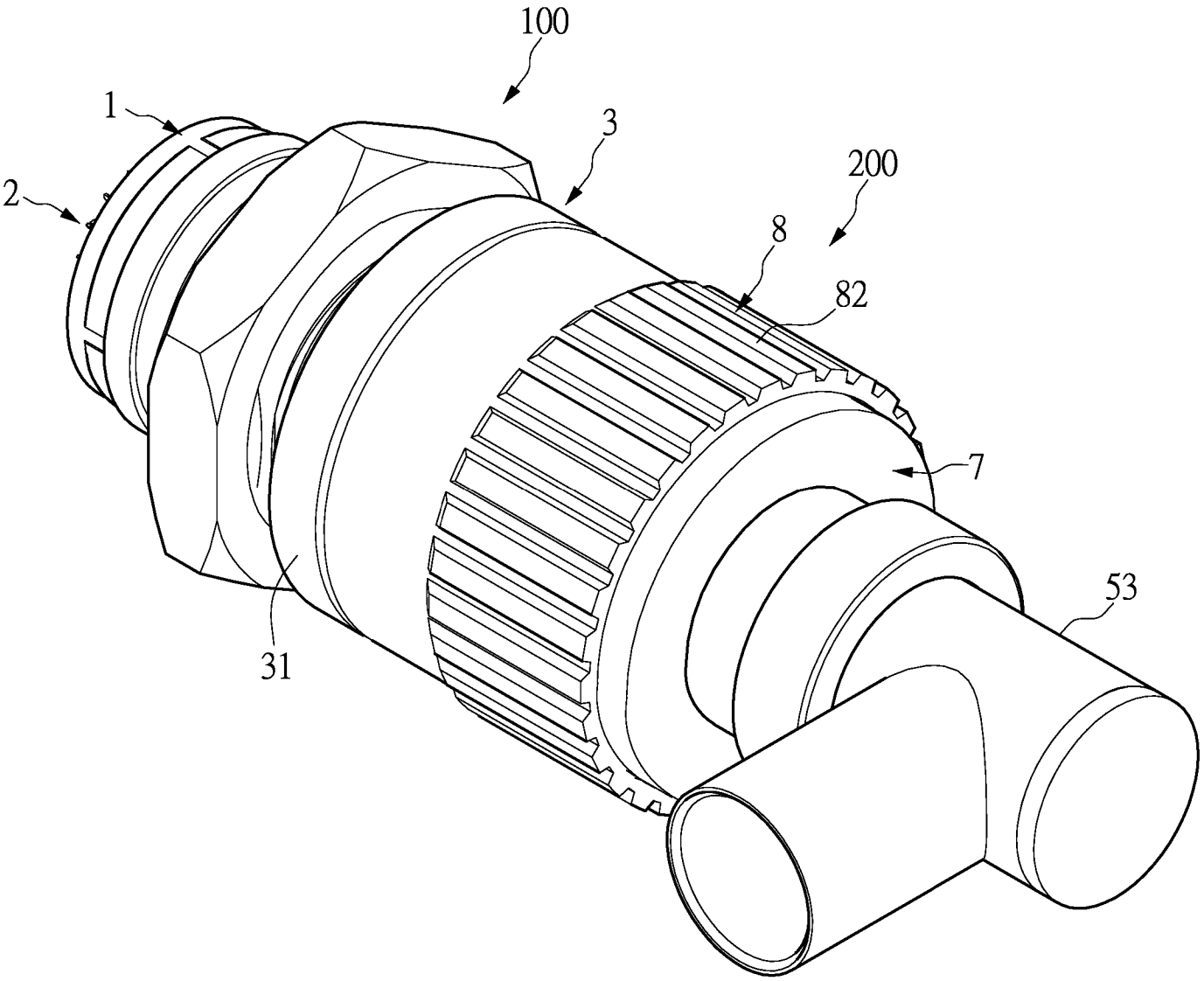
FIG. 2 is a perspective view showing a connected state of the connecting device according to the embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Embodiment

Figure 3:
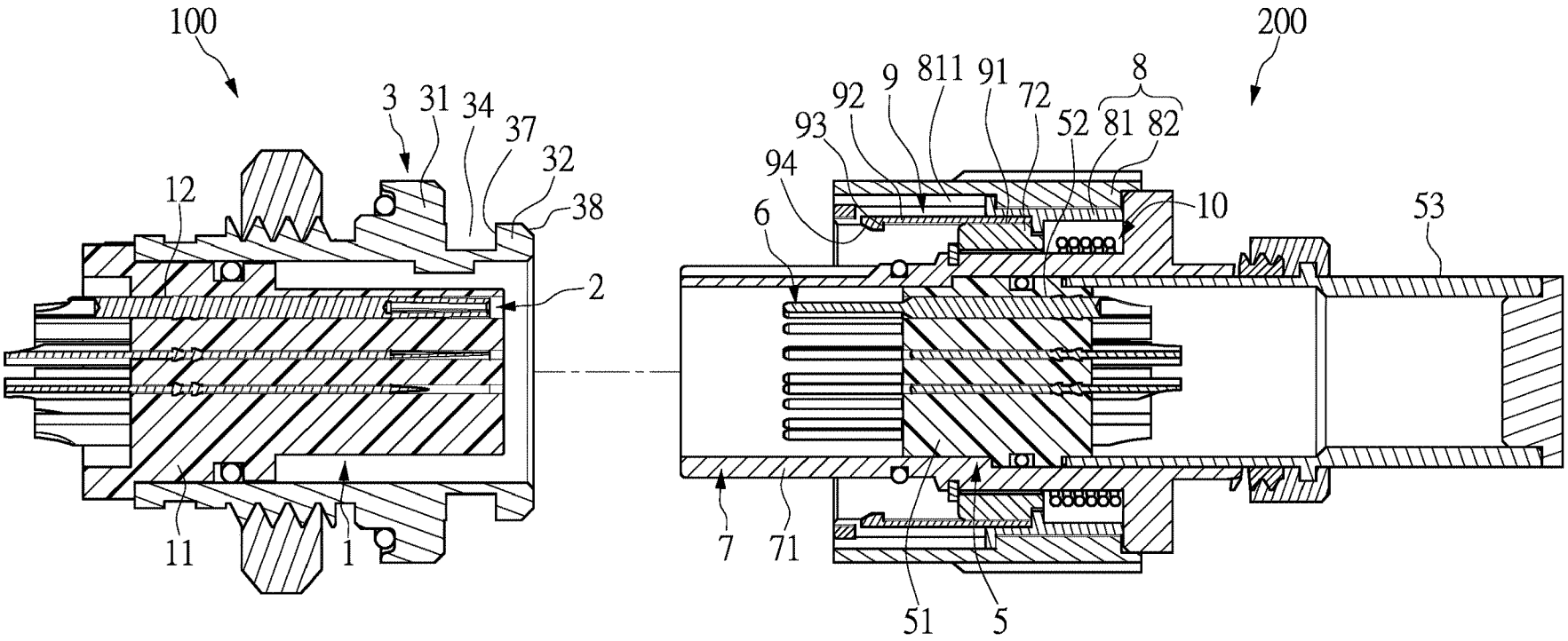
FIG. 3 is a cross-sectional view showing the separated state of the connecting device according to the embodiment of the present disclosure.
Figure 4:
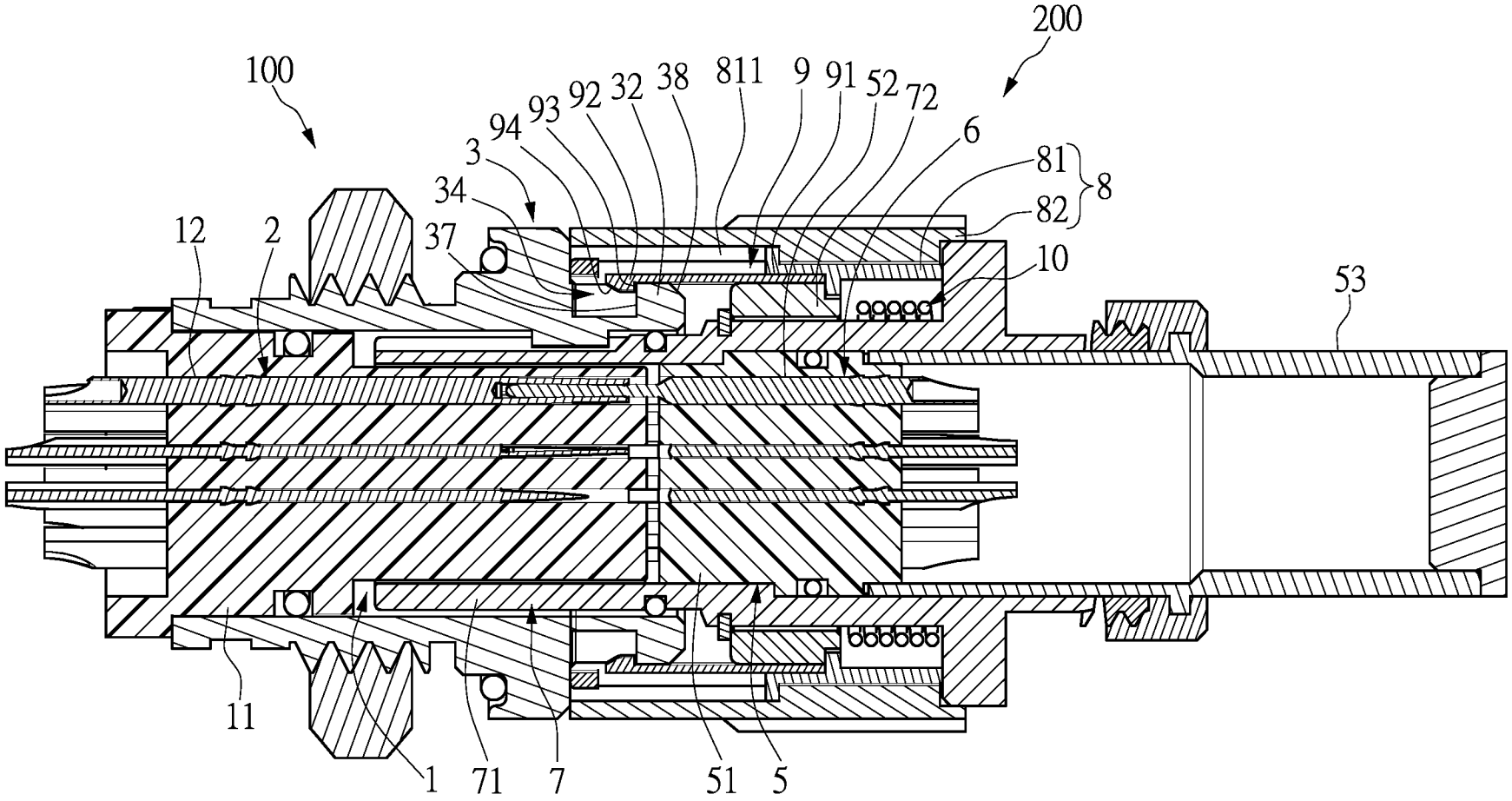
FIG. 4 is a cross-sectional view showing the connected state of the connecting device according to the embodiment of the present disclosure.
Figure 5:
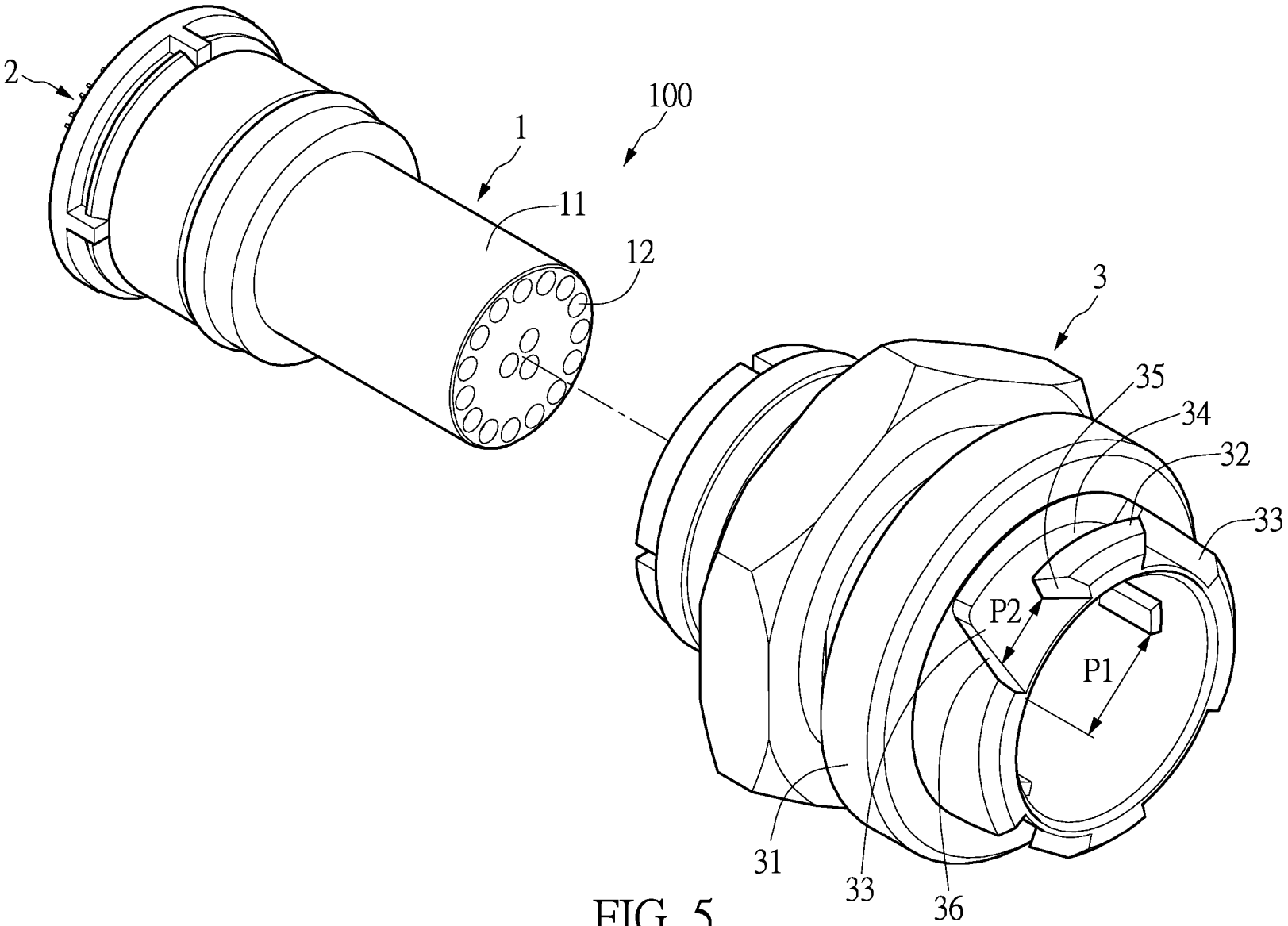
FIG. 5 is an exploded view showing a first connector according to the embodiment of the present disclosure.
Figure 6:
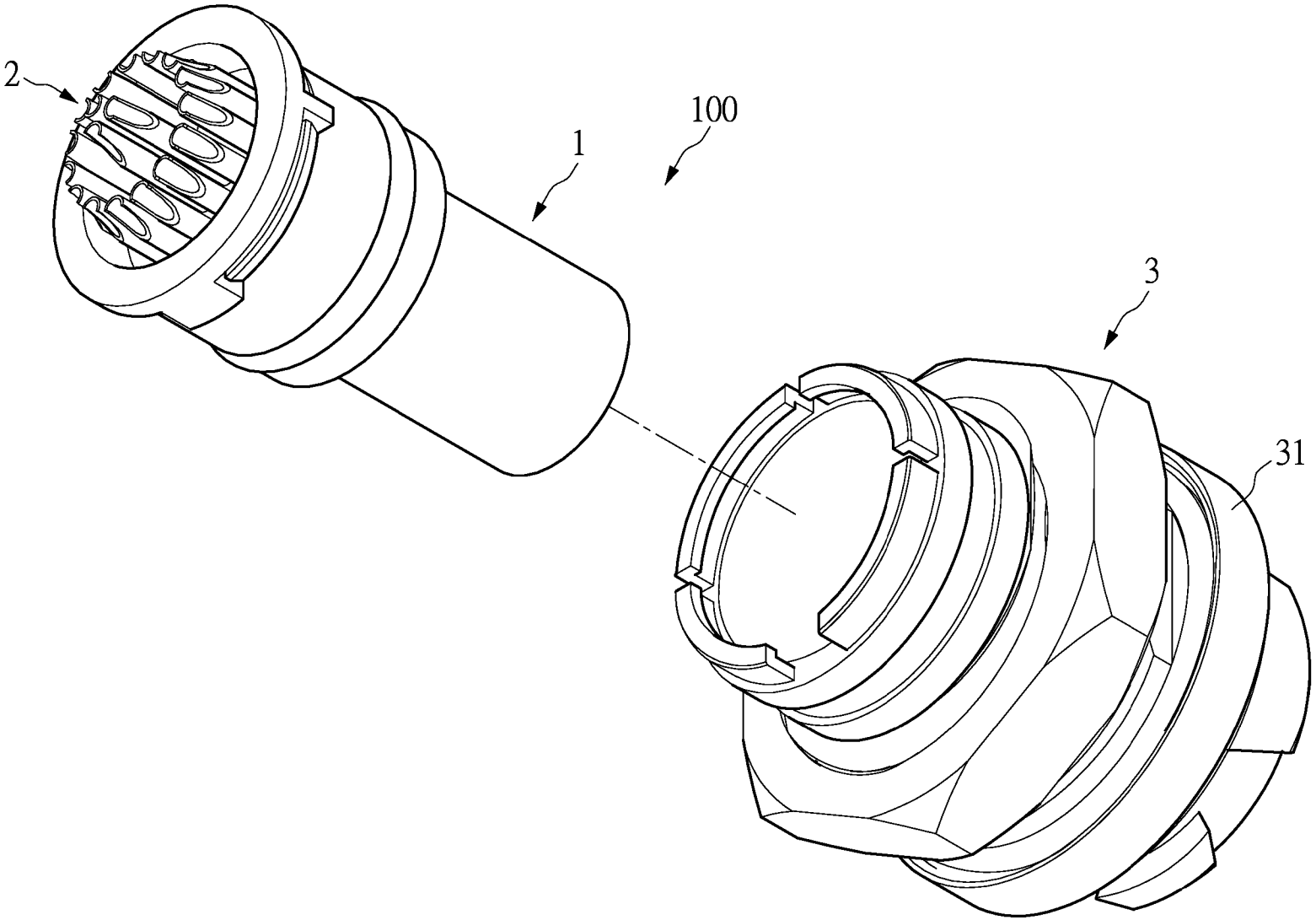
FIG. 6 is another exploded view showing the first connector according to the embodiment of the present disclosure.

Referring to FIG. 1 to FIG. 4, which are to be read in conjunction with FIG. 5 and FIG. 6, an embodiment of the present disclosure provides a connecting device including a first connector 100 and a second connector 200. The first connector 100 includes a first insulating body 1, a plurality of first terminals 2 and a first outer housing 3.

The first insulating body 1 is made of a plastic material and is an insulator. The first insulating body 1 has a first body portion 11 and a plurality of first terminal holes 12. The first terminal holes 12 are disposed through the first body portion 11. More specifically, the first terminal holes 12 penetrate through a front end and a rear end of the first body portion 11 to facilitate mounting of the first terminals 2.

It should be noted that the "front end" described in each component of the present embodiment refers to one end of the component close to a docking portion of the two connectors 100 and 200, and the "rear end" refers to the other end of the component away from the docking portion. That is, one end of the component facing a plugging direction is defined as the "front end", and the other end of the component facing away from the plugging direction is defined as the "rear end".

The first terminals 2 are made of a metal material with electrical conductivity. The first terminals 2 are disposed through the first insulating body 1. The first terminals 2 can be used as power terminals, signal terminals, and the like. The first terminals 2 respectively pass through the first terminal holes 12 such that the first terminals 2 are disposed through the first insulating body 1. The rear ends of the first terminals 2 protrude from the rear end of the first insulating body 1 for electrical connection with devices such as circuit board.

The first outer housing 3 is made of a plastic material and is an insulator. The first outer housing 3 is sleeved outside the first insulating body 1. The first outer housing 3 has a first housing portion 31, and the front end of the first housing portion 31 has a plurality of first buckle bodies 32. In the present embodiment, the front end of the first housing portion 31 has two first buckle bodies 32. Further, the first housing portion 31 has four first grooves 33 and two second grooves 34, any two of the four first grooves 33 adjacent to each other are arranged at two opposite sides of one of the two first buckle bodies 32, and the two second grooves 34 are respectively arranged at rear sides of the two first buckle bodies 32. In each of the first buckle bodies 32, the corresponding two first grooves 33 and the corresponding second groove 34, the rear ends of the two first grooves 33 communicate with the second groove 34. Preferably, an extension direction of each of the first grooves 33 is parallel to an axial direction of the first connector 100 (i.e. plugging and unplugging direction), and an extending direction of each of the second grooves 34 is perpendicular to the axial direction of the first connector 100.

As shown in FIG. 5, two opposite sides of each of the first grooves 33 respectively has a first inclined face 35 and a second inclined face 36. In each of the first grooves 33, a distance P1 between the front end of the first inclined face 35 and the front end of the second inclined face 36 is greater than a distance P2 between the rear end of the first inclined face 35 and the rear end of the second inclined face 36, such that a width of the first groove 33 is increased from the rear end toward the front end to achieve a better guiding effect.

Figure 7:
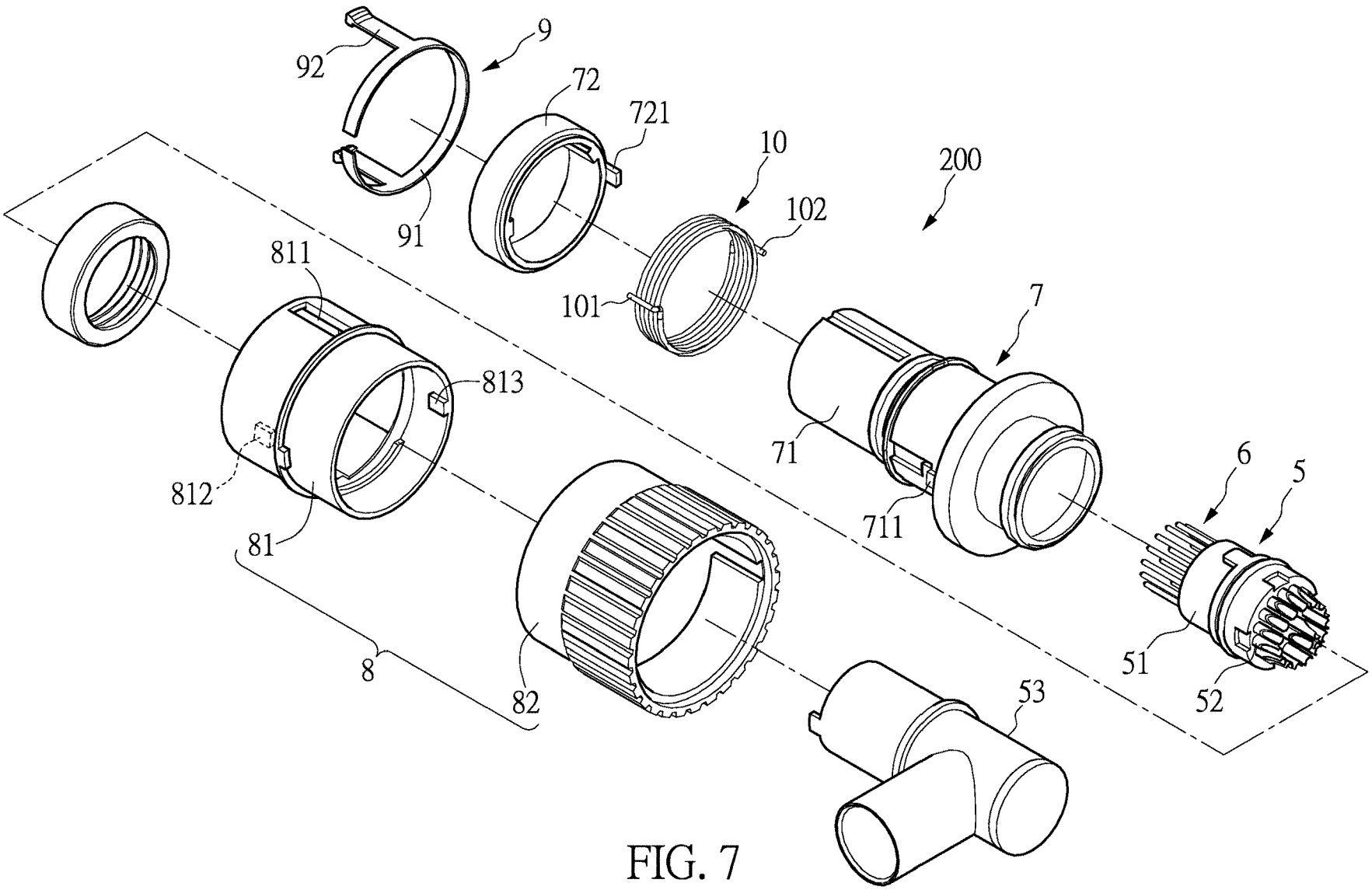
FIG. 7 is an exploded view showing a second connector according to the embodiment of the present disclosure.
Figure 8:
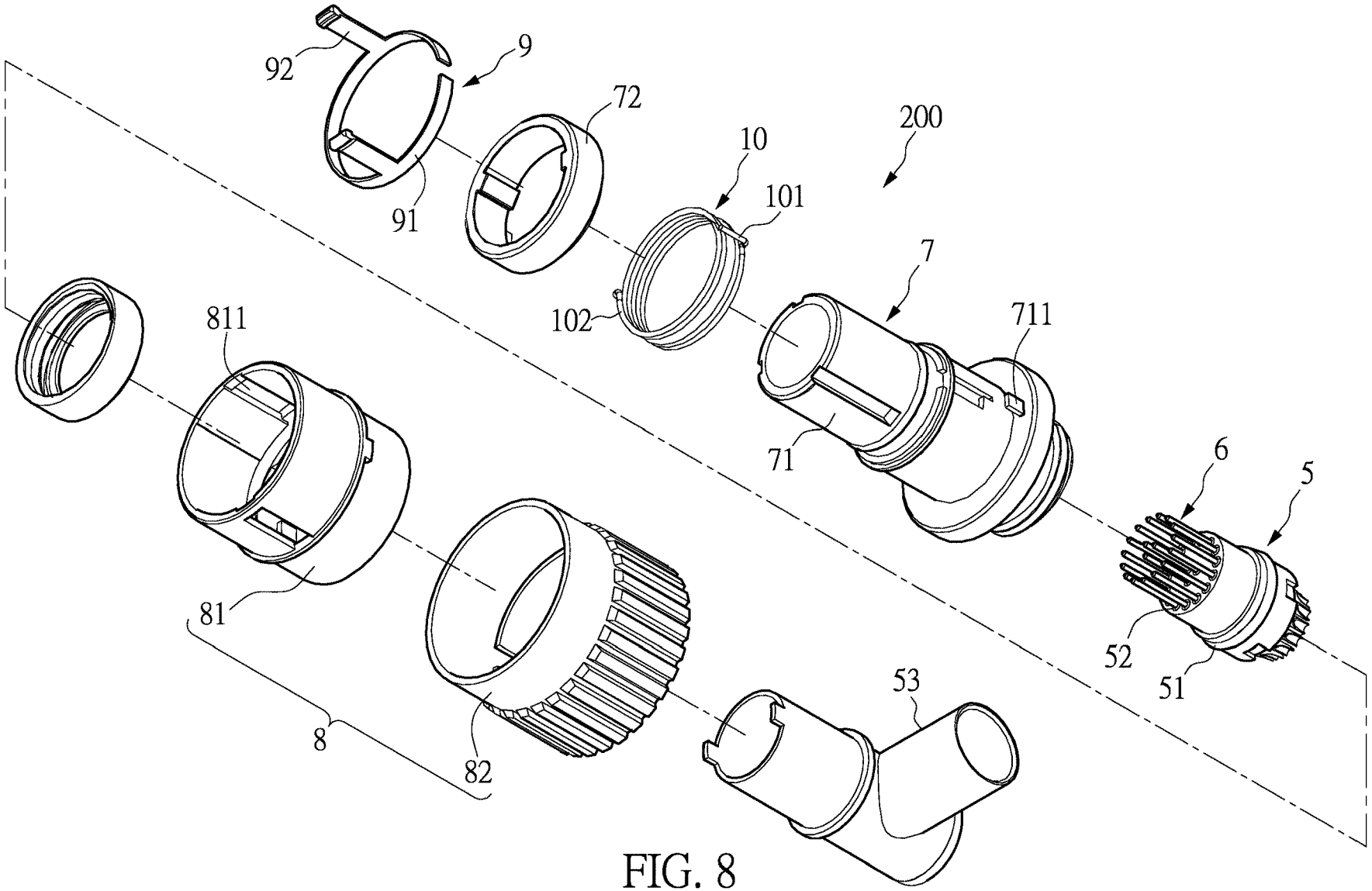
FIG. 8 is another exploded view showing the second connector according to the embodiment of the present disclosure.

Referring to FIG. 7 and FIG. 8, the second connector 200 includes a second insulating body 5, a plurality of second terminals 6, an inner housing 7, a second outer housing 8, a locking member 9 and an elastic member 10.

The second insulating body 5 is made of a plastic material and is an insulator. The second insulating body 5 has a second body portion 51 and a plurality of second terminal holes 52, and the second terminal holes 52 are disposed through the second body portion 51. More specifically, the second terminal holes 52 penetrate through the front end and the rear end of the second body portion 51 to facilitate mounting of the second terminals 6.

The second terminals 6 are made of a metal material with electrical conductivity. The second terminals 6 are disposed through the second insulating body 5. The second terminals 6 can be used as power terminals, signal terminals, and the like. The second terminals 6 respectively pass through the second terminal holes 52 such that the second terminals 6 are disposed through the second insulating body 5. The rear ends of the second terminals 6 protrude from the rear end of the second insulating body 5 for electrical connection with devices such as cable. The second connector 200 further includes a tubular sleeve 53 connected to the rear end of the second body portion 51 of the second insulating body 5, and the tubular sleeve 53 is provided for the cable to pass through.

The inner housing 7 is made of a plastic material and is an insulator. The inner housing 7 includes an inner housing body 71 and a ring body 72. The ring body 72 is sleeved outside the inner housing body 71 and is fixed onto the inner housing body 71. The inner housing 7 is sleeved outside the second insulating body 5.

The second outer housing 8 is made of a plastic material and is an insulator. The second outer housing 8 can be of a two-piece design. The second outer housing 8 includes an inner cylinder 81 and an outer cylinder 82, and the outer cylinder 82 is sleeved outside the inner cylinder 81. The inner cylinder 81 is engaged with the outer cylinder 82 and is fixed onto the outer cylinder 82. The second outer housing 8 is sleeved outside the inner housing 7 in a rotatable manner.

The locking member 9 has a locking body 91 and a plurality of second buckle bodies 92 (the number of the second buckle bodies 92 in the present embodiment is two). The locking body 91 is ring-shaped. The second buckle bodies 92 are connected to the locking body 91, and the second buckle bodies 92 extend toward the front end of the locking member 9. Each of the second buckle bodies 92 is a buckle having an elastic arm. The second buckle bodies 92 correspond in position to the first buckle bodies 32, respectively. The locking body 91 of the locking member 9 is fixed onto an inner side of the second outer housing 8, such that the locking member 9 is disposed inside the second outer housing 8. The inner cylinder 81 of the second outer housing 8 has a plurality of through holes 811 (the number of the through holes 811 in the present embodiment is two), and the through holes 811 correspond in position to the second buckle bodies 92, such that the second buckle bodies 92 are elastically swingable via the through holes 811.

Preferably, in each of the first buckle bodies 32 and the corresponding second buckle body 92, the rear end of the first buckle body 32 has a first buckle face 37, and the first buckle face 37 is perpendicular to the axial direction of the first connector 100 (i.e. plugging and unplugging direction).

The second buckle body 92 has a second buckle face 93, and the second buckle face 93 is also perpendicular to the axial direction of the first connector 100 (i.e. plugging and unplugging direction). The first buckle face 37 is configured to be engaged with (is attached to) the second buckle face 93, such that the first buckle body 32 and the second buckle body 92 can have a better buckling effect. Moreover, the front end of the first buckle body 32 has a first guiding face 38, the front end of the second buckle body 92 has a second guiding face 94, and both the first guiding face 38 and the second buckle body 92 may be inclined surfaces or curved surfaces, so that the first buckle body 32 and the second buckle body 92 can be smoothly buckled with each other.

The elastic member 10 of the present embodiment is a spring providing torque. The elastic member 10 is disposed between the inner housing 7 and the second outer housing 8. The elastic member 10 is configured to push the second outer housing 8 to its original position. More specifically, when a user rotates the second outer housing 8, the second outer housing 8 is configured to compress the elastic member 10 to store kinetic energy; and when the user releases the force applied to the second outer housing 8, the elastic member 10 is configured to push the second outer housing 8 to its original position.

In the present embodiment, the elastic member 10 is sleeved outside the inner housing body 71 of the inner housing 7. The inner housing 7 includes a first stop portion 711 and a second stop portion 721, and the second outer housing 8 includes a third stop portion 812 and a fourth stop portion 813. In the present embodiment, the first stop portion 711 and the second stop portion 721 are respectively disposed on the inner housing body 71 and the ring body 72 of the inner housing 7. Further, the third stop portion 812 and the fourth stop portion 813 are disposed on the inner cylinder 81 of the second outer housing 8. In the present embodiment, two end portions of the elastic member 10 are respectively defined as a first end portion 101 and a second end portion 102. The first end portion 101 of the elastic member 10 is configured to abut against the first stop portion 711 and the third stop portion 812, and the second end portion 102 of the elastic member 10 is configured to abut against the second stop portion 721 and the fourth stop portion 813 so as to bi-directionally compress the elastic member 10, and the elastic member 10 can have a good limiting effect. However, positioning methods of the two end portions of the elastic member 10 is not limited.

When the second outer housing 8 rotates along a clockwise direction or a counterclockwise direction, the third stop portion 812 or the fourth stop portion 813 of the second outer housing 8 are configured to push the first end portion 101 or the second end portion 102 of the elastic member 10 to store kinetic energy. When the user releases the force applied to the second outer housing 8, the first end portion 101 or the second end portion 102 of the elastic member 10 are configured to push the second outer housing 8 to its original position, so that the second buckle bodies 92 of the locking member 9 can correspond in position to the first buckle bodies 32 of the first connector 100.

Referring to FIG. 3 and FIG. 4, when the first connector 100 is plugged into the second connector 200, the first terminals 2 are respectively in contact with the second terminals 6 to achieve electrical connection, and the first buckle bodies 32 can be respectively buckled to the second buckle bodies 92. More specifically, the front ends of the second buckle bodies 92 can respectively slide over the first buckle bodies 32, so that the front ends of the second buckle bodies 92 can be respectively engaged with the rear ends of the first buckle bodies 32 to provide a locking function. At this time, the front ends of the second buckle bodies 92 are respectively located in the second grooves 34 located at the rear sides of the first buckle bodies 32. When a user wants to separate the first connector 100 and the second connector 200, the user can rotate the second outer housing 8 along the clockwise direction or the counterclockwise direction, such that the front ends of the second buckle bodies 92 can respectively slide to the rear ends of the adjacent first grooves 33 through the second grooves 34, and then the front ends of the second buckle bodies 92 can respectively slide to the front ends of the adjacent first grooves 33 to provide an unlocking function. In other words, when the second outer housing 8 rotates along the clockwise direction or the counterclockwise direction, the front ends of the second buckle bodies 92 can sequentially exit through the second grooves 34 and the first grooves 33 to provide the unlocking function.

In conclusion, the beneficial effects of the present embodiment are that when a user wants to separate the first connector and the second connector, the user can rotate the second outer housing along a clockwise direction or a counterclockwise direction, such that the second buckle bodies can respectively slide to the rear ends of the adjacent first grooves through the second grooves, and then the second buckle bodies can respectively slide to the front ends of the adjacent first grooves to separate the first buckle bodies and the second buckle bodies, thereby providing an unlocking function. The connecting device of the present embodiment has a bi-directional unlocking function to facilitate the unlocking operation.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A connecting device, comprising:

a first connector including a first insulating body, a plurality of first terminals and a first outer housing; wherein the first terminals are disposed through the first insulating body, the first outer housing is sleeved outside the first insulating body, the first outer housing has a first housing portion, and the front end of the first housing portion has a plurality of first buckle bodies; wherein the first outer housing further has a plurality of first grooves and a plurality of second grooves, any two of the first grooves adjacent to each other are arranged at two opposite sides of one of the first buckle bodies, and the second grooves are respectively arranged at rear sides of the first buckle bodies; wherein in each of the first buckle bodies and the corresponding two first grooves and the corresponding second groove, the rear ends of the two first grooves communicate with the second groove; and a second connector including a second insulating body, a plurality of second terminals, an inner housing, a second outer housing, a locking member and an elastic member; wherein the second terminals are disposed through the second insulating body, the inner housing is sleeved outside the second insulating body, and the second outer housing is sleeved outside the inner housing in a rotatable manner; wherein the locking member has a locking body and a plurality of second buckle bodies, the second buckle bodies are connected to the locking body, the locking body of the locking member is fixed onto the second outer housing, the elastic member is disposed between the inner housing and the second outer housing, and the elastic member is configured to push the second outer housing to its original position;

wherein when the first connector is plugged into the second connector, the first terminals are respectively in contact with the second terminals to achieve electrical connection, the first buckle bodies are configured to be respectively buckled to the second buckle bodies to be lockingly engaged with each other, and the second buckle bodies are located in the second grooves located at the rear sides of the first buckle bodies, respectively;

wherein when the first connector and the second connector are to be separated, the second outer housing are capable of being rotated along a clockwise direction or a counterclockwise direction, so that the second buckle bodies can respectively slide to the rear ends of the adjacent first grooves through the second grooves, and then the second buckle bodies can slide to the front ends of the adjacent first grooves, respectively, to be lockingly engaged with each other.

2. The connecting device according to claim 1, wherein a width of each of the first groove is increased from the rear end toward the front end.

3. The connecting device according to claim 2, wherein two opposite sides of each of the first grooves has a first inclined face and a second inclined face, respectively; wherein in each of the first grooves, a distance between the front end of the first inclined face and the front end of the second inclined face is greater than a distance between the rear end of the first inclined face and the rear end of the second inclined face.

4. The connecting device according to claim 1, wherein the inner housing includes an inner housing body and a ring body, and the ring body is sleeved outside the inner housing body and is fixed onto the inner housing body; the second outer housing includes an inner cylinder and an outer cylinder, and the outer cylinder is sleeved outside the inner cylinder; the elastic member is sleeved outside the inner housing body of the inner housing; the inner housing body has a first stop portion, the ring body has a second stop portion, and the inner cylinder of the second outer housing has a third stop portion and a fourth stop portion; and two end portions of the elastic member are defined as a first end portion and a second end portion, respectively, the first end portion of the elastic member is configured to abut against the first stop portion and the third stop portion, and the second end portion of the elastic member is configured to abut against the second stop portion and the fourth stop portion.

5. The connecting device according to claim 4, wherein the inner cylinder of the second outer housing has a plurality of through holes, and the through holes correspond in position to the second buckle bodies.

6. The connecting device according to claim 1, wherein the inner housing includes a first stop portion and a second stop portion, and the second outer housing includes a third stop portion and a fourth stop portion; and two end portions of the elastic member are respectively defined as a first end portion and a second end portion, the first end portion of the elastic member is configured to abut against the first stop portion and the third stop portion, and the second end portion of the elastic member is configured to abut against the second stop portion and the fourth stop portion.

7. The connecting device according to claim 1, wherein in each of the first buckle bodies and the corresponding second buckle body, the rear end of the first buckle body has a first buckle face, the second buckle body has a second buckle face, and the first buckle face is configured to be engaged with the second buckle face; wherein the first buckle face is perpendicular to an axial direction of the first connector, and the second buckle face is also perpendicular to the axial direction of the first connector.

8. The connecting device according to claim 1, wherein an extension direction of each of the first grooves is parallel to an axial direction of the first connector, and an extending direction of each of the second grooves is perpendicular to the axial direction of the first connector.

9. The connecting device according to claim 1, wherein in each of the first buckle bodies and the corresponding second buckle body, the front end of the first buckle body has a first guiding face, the front end of the second buckle body has a second guiding face, and both the first guiding face and the second buckle body are inclined surfaces or curved surfaces for guiding the first buckle body and the second buckle body to buckle with each other.

* * * * *